US009761102B2

(12) United States Patent
Guetta et al.

(10) Patent No.: US 9,761,102 B2
(45) Date of Patent: Sep. 12, 2017

(54) TERRAIN SURVEILLANCE SYSTEM

(75) Inventors: Avishay Guetta, Rehovot (IL); Michael Yagudaev, Beit Hashmonai (IL); Doron Korngut, Modi'in (IL)

(73) Assignee: SHILAT OPTRONICS LTD., Rehovot (IL)

( * ) Notice: Subject to any disclaimer, the term of this patent is extended or adjusted under 35 U.S.C. 154(b) by 838 days.

(21) Appl. No.: 14/115,392

(22) PCT Filed: May 3, 2012

(86) PCT No.: PCT/IL2012/000181

§ 371 (c)(1),
(2), (4) Date: Feb. 3, 2014

(87) PCT Pub. No.: WO2012/150590

PCT Pub. Date: Nov. 8, 2012

(65) Prior Publication Data

US 2014/0168633 A1 Jun. 19, 2014

Related U.S. Application Data

(60) Provisional application No. 61/481,775, filed on May 3, 2011.

(51) Int. Cl.
*G08B 13/189* (2006.01)
*G08B 13/184* (2006.01)

(52) U.S. Cl.
CPC ..... *G08B 13/189* (2013.01); *G08B 13/184* (2013.01)

(58) Field of Classification Search
CPC ..... G01S 13/48; G01S 13/52; G01S 13/74; G01S 15/46; G01S 17/46; G01S 13/862;
(Continued)

(56) References Cited

U.S. PATENT DOCUMENTS 4,319,332 A 3/1982 Mehnert
6,774,369 B2 8/2004 Haufe
(Continued)

FOREIGN PATENT DOCUMENTS

DE 19947023 A1 5/2001
WO WO 2006/115397 A2 11/2006
(Continued)

OTHER PUBLICATIONS

Extended European Supplementary Search Report of the European Patent Office in corresponding European patent EP 12779768.6, dated May 11, 2014.
(Continued)

*Primary Examiner* — Luke Ratcliffe
(74) *Attorney, Agent, or Firm* — Daniel J. Swirsky; AlphaPatent Associates Ltd.

(57) ABSTRACT

A system for the surveillance of terrain and the detection of intrusions over a plane extending into that terrain. A curtain array of light beams is projected along the plane and reflections from the terrain are detected by a sensor array essentially spatially coincident with the array of light sources. The times of flight of the beams are determined, and these characterize the form of the terrain being surveilled. The initial background reflection pattern is acquired and stored by the system. A sudden change in this detected background pattern can be defined as arising from an unexpected reflection, indicative of an intrusion. Signal processing systems are described utilizing modulated laser beams and detection at a frequency at least twice that of the modulation, such that reflected signals arising from the ON and the OFF periods of the laser modulation can be subtracted to eliminate the background signals.

16 Claims, 5 Drawing Sheets

(58) Field of Classification Search
CPC ..... G01S 7/4056; G01S 7/4972; G01S 15/89; G01S 2007/403; G01S 2007/4091; G01S 13/867
See application file for complete search history.

(56) References Cited

U.S. PATENT DOCUMENTS

| | | | | |
|---|---|---|---|---|
| 7,773,204 | B1 * | 8/2010 | Nelson | G01S 13/48 356/5.02 |
| 2005/0195383 | A1 * | 9/2005 | Breed | B60N 2/002 356/4.01 |
| 2010/0097216 | A1 | 4/2010 | Morcom | |
| 2011/0043806 | A1 | 2/2011 | Guetta et al. | |
| 2011/0216304 | A1 * | 9/2011 | Hall | G01S 7/4813 356/4.01 |

FOREIGN PATENT DOCUMENTS

| | | | |
|---|---|---|---|
| WO | WO2009144707 | A1 | 12/2009 |
| WO | WO2011073980 | A1 | 6/2011 |

OTHER PUBLICATIONS

PCT International Search Report and Written Opinion of the ISA, mailed Sep. 27, 2012 in PCT/IL2012/000181.

* cited by examiner

TERRAIN SURVEILLANCE SYSTEM

CROSS-REFERENCE TO RELATED APPLICATIONS

This application is a U.S. National Phase application under 35 U.S.C. 371 of International Application No. PCT/IL2012/000181, which has an international filing date of May 3, 2012, and which claims the benefit of priority from U.S. Provisional Patent Application No. 61/481,775, filed on May 3, 2011, which applications are incorporated herein by reference in their entirety.

The present invention relates to the field of the surveillance of terrain in order to map and measure that terrain, and thereby to detect unauthorized intrusion within that terrain, especially using optical techniques.

BACKGROUND OF THE INVENTION

Virtual fencing may be used for protecting or securing a separation line against intrusion by unwanted persons or objects in applications where a physical fence is inadequate or impractical, such as over long distances or where the terrain is too rough, or the cost is too high. The virtual fence could be used to protect a border, or the perimeters of an enclosed security area such as an airport, a strategic site, a hospital or university campus, fields and farms, or even private houses and estates The virtual fence should provide warning about the intended intrusion, and should be able to provide information about the location and type of intrusion expected. Current solutions based on video camera imaging, and using signal processing to detect changes in those images, generally have a number of disadvantages which have limited their widespread deployment, especially for border use over long distances, or in regions where the terrain is rough. Such video systems may have high false alarm rates (FAR), limited capabilities for screening irrelevant intrusions such as by animals, significant power consumption, and they could be costly in capital expenses. A system which overcomes at least some of the disadvantages of such prior art systems and methods would therefore be advantageous.

In International Patent Application No. PCT/IL2009/000417 for "Intrusion Warning System", incorporated herewith by reference in its entirety, there is described an intrusion detection system based on a method of detecting reflections from an array of individually distinguished light beams directed in predetermined direction into the field of view, using an array of detectors, each detector viewing a predetermined direction in the field of view. Any significant change in detected light is interpreted as a change in the features of the field of view being surveilled, which may be attributed to an intrusion. By identifying the specific light beam detected, and the detector in the array which detects the change in detected light, the spatial position of the intrusion can be determined as the crossing point of the identified light beam and the field of view of the detector detecting the change. Such systems essentially perform mapping of the field of view being surveilled, and can thus be used for terrain mapping and range-finding as well as for intrusion detection.

The method described in PCT/IL2009/000417 is a parallax method, using triangulation to determine the position of the intrusion. This is shown in FIG. 1, where the intrusion at point X is being detected by detector 10 detecting a change in the level of the light reflected from impingement of laser 30 on the point X in the field. The accuracy with which the intrusion position can be located is dependent on D, the distance to the intrusion, and d, the distance between the detector element and the laser diode emitting point, both of which are typically mounted on a vertical baseline post 12.

For a separation of 30 cm, and for a detector array having a pixel size such that the pixel field resolution is 15 mm, an intrusion at a distance of 200 meters can be detected with an accuracy of 10 m. Because of the square law relationship with distance, using the same system, an intrusion at 50 m can be detected with an accuracy of 0.62 m. In general, the greater the value of d/D, the greater is the accuracy of the location measurement. However, a large value of d means that the laser array and the detector array must be widely spaced, and the physical size of the instrument must also be large, and this may make the system cumbersome to install and use, and easy to detect by a potential intruder. There therefore exists a need for an intrusion detection system, or a terrain surveillance system providing similar performance to that described in PCT/IL2009/000417, but having a more compactly sized package.

The disclosures of each of the publications mentioned in this section and in other sections of the specification are hereby incorporated by reference, each in its entirety.

SUMMARY

The present disclosure describes new exemplary systems for the surveillance of terrain and the detection of intrusions over a plane extending into that terrain, combining low capital cost and high sensitivity with a low false alarm rate (FAR). The systems are based on the generation of a curtain array of light beams projected along a plane extending into the field to be surveilled, and the detection of the distance and height of any reflection from this array of light beams, by means of a detection array, detecting imaged fields of view along that plane within the field of view surveilled. Such reflections arise from impingements of the beams with objects along the plane being surveilled by the detector imaging array. Since the initial background reflection pattern without any intrusion can be acquired and stored by the system, a sudden change in this detected background pattern can be defined as arising from an unexpected reflection, and hence indicative of an intrusion. Slow changes can be attributed to gradual changes in the background and can be ignored. The systems described herewithin utilize the times of flight of the laser beams, from transmission to detection, in order to characterize the form of the terrain being surveilled.

The angular direction from which the reflection originates is known from the knowledge of which particular detector pixel has detected the reflection signal, since each pixel is directed to monitor a different angular direction of the field of view. The longitudinal position along the line of detection from which the reflection is generated is known from the time of flight of the laser beam reflected into that detector pixel. Since each laser beam in the curtain is directed at a specific direction in the plane, and each detector pixel is also directed at its own specific direction in the plane, each pixel can be uniquely associated with a specific laser beam, and is essentially bore-sighted with its associated laser beam. Thus, the time of flight of each laser beam, from transmission from the source to the detection of the reflection of that beam by its own associated detector pixel, enables the longitudinal position from which the reflection took place to be determined. Thus, measurement of a change in the time of flight of a beam as detected at its associated pixel, enables the distance of an intrusion to be determined, and the height above the terrain level can be determined by knowledge of the specific beam in which the change in time of flight has been detected. The time of flight may be conveniently determined by measuring the change in phase of the modulated laser beam between it transmission and its detection.

The system can also be used to map the terrain profile or to simply measure the range to a feature in the field, by using the time of flight to determine the distance to the reflection generating point, and by knowing the angle at which the reflection generating point is situated by knowledge of which transmitted laser beam is associated with which detector pixel, as determined by an initial calibration scan or alignment procedure.

Essentially, the system thus operates by detecting reflections from a fanned out array of illuminating beams with an array of detection fields of view. In practice the illuminating beams of the array may be activated to cover the entire area along the plane under surveillance, and the ensuing image pattern compared with a previously recorded background image pattern. Any change in the time of flight pattern may be interpreted as the introduction of an intrusion. By recording the sequential temporal positions of the detected intrusion, an outline of a moving intruder can be generated. This outline can be analyzed in a signal processing module, in order to determine whether it is a human, a vehicle or just an animal.

The various systems of this disclosure have been described generally in terms of the detection of "an intrusion" or "an intruder" over the perimeter line of a region to be safeguarded, and has thuswise been claimed. However, it is to be understood that this terminology is not intended to limit the claimed invention strictly to the detection of unwanted personnel or objects, but is so used as the most common application of such systems of this disclosure. The term intrusion or intruder detection is therefore also to be understood to include the detection of a change in the presence of any object within the surface being surveilled by the system, whether the "intrusion" of this object is being detected for warning purposes, or whether for positive detection purposes. Examples of the latter use could include, for instance, the detection of vehicles on a highway sorted according to lane, or the counting of wild animals in motion across a region, or any other remote spatial detection task suited to such systems. In this respect, the present disclosure describes what can be generically termed an Optical Detection and Ranging System, or ODRS.

One exemplary implementation of the systems described in this disclosure for detecting an intrusion comprises:

(i) an array of illuminating sources, adapted to direct illuminating beams along a plurality of angularly divergent optical paths, (ii) an array of detector elements, adapted to image reflected light from the plurality of angularly divergent optical paths, and (iii) a signal processing unit adapted to determine the time of flight of any one of the illuminating beams, between the time of transmission from its illuminating source to the time of detection in its detection element, wherein a change detected in the time of flight indicates that an intrusion has occurred.

In such a system, the signal processing unit may be adapted to determine the location of the intrusion by measuring the time of flight of the illuminating beam in which the change has been detected, and by identifying that of the angularly divergent optical paths in which the change in the time of flight has been detected.

In yet other implementations, each angularly divergent optical path may have associated with it a known one of the illuminating beams and a known one of the detector elements, such that the time of flight of any one of the illuminating beams can be determined from its transmission from its illuminating source to its detection in its known associated detection element.

Alternatively, the illuminating sources may be directed at angles corresponding to the angles at which the detector elements image illumination from the field of view, such that at least some of the illumination sources are directly associated angularly with corresponding ones of the detector elements.

In any of the above described systems, the time of flight may be determined by the phase delay of an illuminated beam between transmission and detection. Furthermore, the illuminating sources may be modulated such that the phase delay can be determined at a frequency substantially less than the frequency of the illuminating source.

In such systems, the plurality of angularly divergent optical paths may conveniently be generated by means of a collimating lens disposed at its focal distance from the array of illuminating sources and detector elements, and the array of illuminating sources may conveniently be a one dimensional pixelated array of laser diodes.

The signal processing unit in any of such systems may further be adapted to detect changes in the intensity of light reflected from the plurality of angularly divergent optical paths, and to temporally correlate any intensity changes detected with changes in the time of flights, such that the intrusion detection can be determined with increased reliability.

Additional implementations may involve systems such as are described above in which the illuminating beams are modulated at a predetermined frequency, and the array of detector elements is configured to image the reflected light at a rate which is a multiple of the predetermined frequency, and wherein the signal processing unit is adapted to subtract signals arising from samples temporally separated from each other by half of the modulation period, such that the subtraction signal is representative of the reflected light from a detected object in the optical paths without the effect of any background illumination. In such a system, the signals temporally separated from each other by half of the modulation period may be accumulated in separate CCD charge registers, such that the accumulated signals can be read out at a rate substantially lower than the predetermined modulation frequency. Furthermore, the subtracted signals arising from samples temporally separated from each other by half of the modulation period, enable the subtraction of signals arising from background illumination from signals arising from the reflected laser beams.

Even further implementations of systems such as are described above may involve illuminating beams modulated at a first frequency, and the array of detector elements configured to image half periods of the reflected light at a second frequency which is separated from the first frequency by a difference frequency which is substantially less than the first frequency, and wherein the signal processing unit may be adapted to subtract signals arising from samples temporally separated from each other by half of the modulation period, such that the subtraction signal is representative of the reflected light without the background illumination reflected from the object. In such a case, the signals temporally separated from each other by half of the modulation period may be accumulated in separate CCD charge registers, such that the accumulated signals can be read out at a rate substantially lower than the first modulation frequency. The accumulated signals are modulated at the difference frequency, such that any phase information impressed thereon can be electronically measured at the difference frequency.

In general, in any of the above described systems, the frequency at which the illuminating beams are modulated should be sufficiently high that the time of flight can be determined with the accuracy desired.

Yet other implementations may involve a method for detecting an intrusion in a region being surveilled, the method comprising:

(i) transmitting an array of illuminating beams into the region along a plurality of optical paths, the optical paths being angularly divergent from the point from which the transmitting is performed, (ii) detecting illumination reflected from the region along the plurality of optical paths, (iii) measuring the time of flight of the illuminating beams from their transmission into the region until their detection after reflection from the region, (iv) detecting changes in the times of flight of the illuminating beams, and (v) using the changes in time of flight of the illuminating beam to determine that an intrusion has occurred.

In such a method, determination of the location of the intrusion may be performed by measurement of the time of flight of the illuminating beam in which the change has been detected, and identification of that one of the plurality of optical paths in which the change in time of flight has been detected.

In yet other implementations, each of the optical paths may have associated with it a known one of the illuminating beams and a known one of the detector elements, such that measuring the time of flight of any one of the illuminating beams can be determined, from its transmission from its illuminating source to its detection in its known associated detection element.

Alternatively, the illuminating beams may be directed at angles corresponding to angles at which the detector elements image illumination from the field of view, such that at least some of the illumination sources have a direct angular association with corresponding ones of the detector elements.

In any of the above described methods, time of flight may be measured either by determining the phase delay in the beam between its transmission and its detection, or by direct determination of the transmission time between transmission and detection of a marker on the illuminating beam. The illuminating beams should be modulated to facilitate measurement of the time of flight.

Additionally, the plurality of angularly divergent optical paths may be generated by means of a collimating lens disposed at its focal distance from the array of illuminating sources and detector elements.

The above described methods may include the further step of detecting changes in the intensity of light reflected from the plurality of optical paths, and temporally correlating any intensity changes detected with the changes in the time of flights, such that the intrusion detection can be determined with increased reliability.

Yet other implementations perform a method such as one of those described above, in which the illuminating beams are modulated at a predetermined frequency, and the step of detecting illumination reflected from the region is performed at a rate which is a multiple of the predetermined frequency, and wherein signals arising from samples temporally separated from each other by half of the modulation period are subtracted from each other, such that the subtraction signal is representative of the light reflected from a detected object in the optical paths without the effect of background illumination. Such a method may further comprise the step of accumulating the signals arising from samples temporally separated from each other by half of the modulation period in separate CCD charge registers, such that the accumulated signals can be read out at a rate substantially lower than the predetermined modulation frequency. Furthermore, the subtracted signals arising from samples temporally separated from each other by half of the modulation period, should enable the subtraction of signals arising from background illumination from signals arising from the reflected laser beams.

Even further implementations of systems such as are described above may involve modulating the illuminating beams at a first frequency, and using the array of detector elements, imaging half periods of the reflected light at a second frequency which is separated from the first frequency by a difference frequency which is substantially less than the first frequency, and wherein the signal processing unit subtracts signals arising from samples temporally separated from each other by half of the modulation period, such that the subtraction signal is representative of the light reflected from a detected object in the optical paths without the effect of background illumination. This method may further comprise the step of accumulating the signals temporally separated from each other by half of the modulation period in separate CCD charge registers, such that the accumulated signals can be read out at a rate substantially lower than the first modulation frequency. By this means, the accumulated signals are modulated at the difference frequency, such that any phase information impressed thereon can be electronically measured at the difference frequency.

Finally, in any of the above described methods, the frequency at which the illuminating beams are modulated should be sufficiently high that the time of flight can be determined with the accuracy desired.

BRIEF DESCRIPTION OF THE DRAWINGS

The presently claimed invention will be understood and appreciated more fully from the following detailed description, taken in conjunction with the drawings in which:

DETAILED DESCRIPTION

Figure 1:
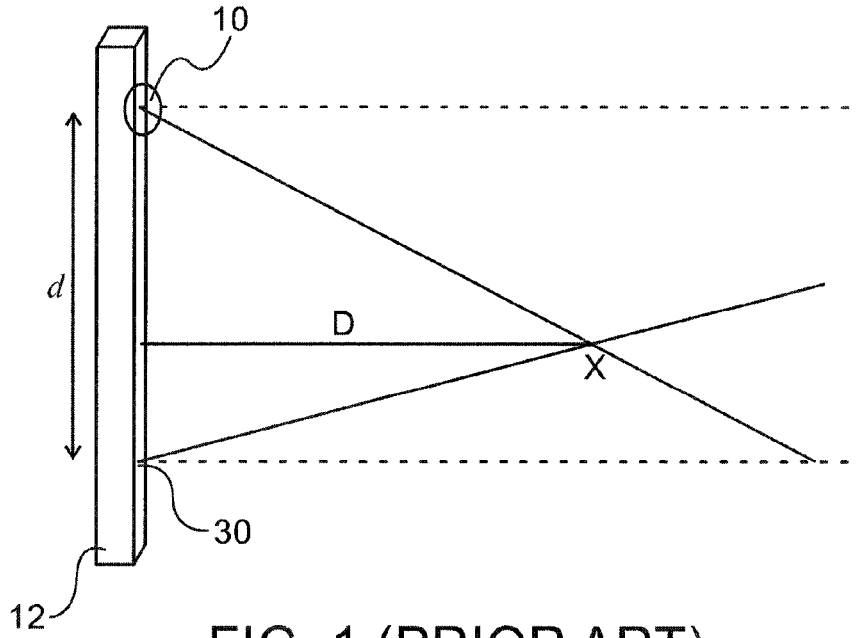
FIG. 1 (PRIOR ART)
FIG. 1 shows schematically a prior art triangulation detection system, using a parallax method, such as that described in PCT/IL2009/000417.
Figure 2:
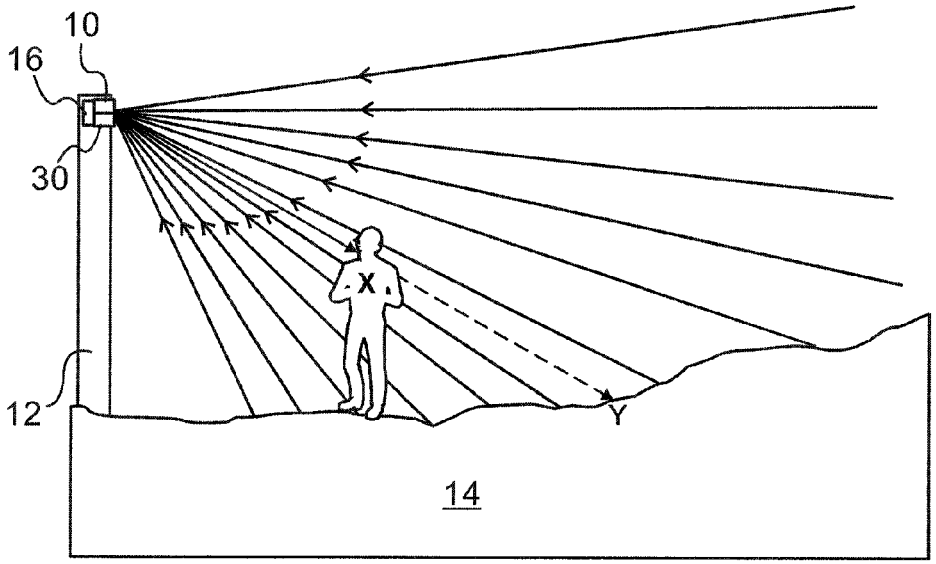
FIG. 2 illustrates schematically an exemplary system for intrusion detection or terrain surveillance and mapping, using an array of projected laser beams, and a closely spaced array of detectors.

Reference is made to FIG. 2, which illustrates an exemplary system for intrusion detection or terrain surveillance and mapping, using two features—an array of projected laser beams, propagating in the form of a curtain, and an array of detectors, each element of which is directed to detect light received from a particular field of view in the terrain to be surveilled. Individual pixels in the detector array are directed at specific angular locations in the field of view, such that each detector pixel is associated with a corresponding one of the array of laser sources. Thus, each individual laser source is aimed at its own specific angular direction, and each individual pixel of the detector array images light coming from its own specific angular direction, such that each pixel is known to image only light reflected from the point of impingement of the laser beam associated with the direction of that pixel. These two features are jointly able to define which beam has impinged on a specific point in the field and at what distance that point is from the base system, by measurement of the time of flight of the relevant beam from its transmission to its detection. This time of flight can be measured most conveniently by measurement of the change in phase of the modulation of the light between transmission and reception, though any alternative method may also be used. In general, in discussing the concepts of methods of this disclosure, the generic term "time of flight" will be used, though it is to be understood that this "time of flight" may in fact be a phase difference measurement, or any other measurement which determines the distance from which impinging light is reflected and detected by the detector array, based on transit time principles. Each beam of the array of laser beams projected into the terrain to be surveilled should be tagged with temporal information so that the point in time at which it is transmitted into the field can be defined, and consequently, the point in time of detection by the detector pixels, of the light of that beam reflected from a point in the field, can also be determined. Such tagging can readily be made by providing some form of modulation of the beams, or by transmitting the laser beams at predetermined intervals. The fan of laser beams thus covers the entire terrain to be surveilled with a curtain of laser beams for each vertical sector of the region to be covered. As an alternative, a curtain of laser beams may be generated from a single laser source, such as by means of a scanner device or a diverging optical element, and the laser source modulated to provide timing information to each segment of the entire curtain beam.

Unlike the prior art intrusion warning system of PCT/IL2009/000417 which uses an offset detector array to provide the necessary spatial discrimination as to which beam is reflecting into which pixel of the detector array, the current system may use an array of detectors located in close proximity to the laser beam projecting source or sources, such that the entire system may be contained in a single compact unit. The detector array is able to discriminate between light reflected from different projected beams by knowledge of which detector pixel or pixels has detected the reflected light, since, at least for a detector array being ideally spatially coincident with the laser transmitting array, such that no parallax error exists between them, each detector pixel is associated angularly with a particular laser source. Therefore, each pixel of the detector array continuously monitors the time of detection of the light received by it from the point in the field which it is directed at, relative to the point of time of departure of that light from the laser source. A change in the time of flight of a specific reflected beam indicates that an intrusion has occurred in the path of that received light, and measurement of the new time of flight indicates the range at which the intrusion has occurred.

Thus, referring again to FIG. 2, the detector array 10 is shown viewing an array of different directions across the terrain 14 being surveilled. The laser source 30 projects an array of beams into the surveilled terrain, and the reflections of those beams from the terrain is detected on the detector array 10, which should be located in juxtaposition to the transmitter array 30. Both transmitter and detector can be mounted on a post 12 in order to provide a good surveillance over a long distance. So long as no intrusion takes place, the detection system measures essentially constant times of flight for each of the projected laser beams whose return is detected. In FIG. 2, one laser beam of the many in the array directed from the source 30, is shown striking the terrain at the point Y in the absence of an intruder, and its time of detection in the detector array 10 is then characteristic of the distance from the transmitter 30 to the point Y and back to the detector 10. As a result of the entry of an intruder X, the laser beam which would have struck the terrain at point Y and been reflected therefrom, is now reflected back from the point X. As a result, an abrupt change is detected in the time of flight of the beam or beams which the intruder intercepts, and a control or signal processing system 16, which can conveniently be located within the transmitter/detector assembly 10/30, detects this change in time of flight. The time of flight measured, can enable the determination of where the intrusion has taken place in terms of distance from the transmitter/receiver unit, and from the particular laser source-sensor combination which detected the intrusion-perturbated beam, the height above the reference ground can be determined. The transmitter 30, detector 10 and control system 16 can thus be incorporated into one compact unit. The closer together the transmitter and detector arrays, the better bore-sighted are the laser transmission directions and the detector detecting direction. In the drawing of FIG. 2, in order to illustrate the construction of the system, the transmitter and detector are not coincident, such that the reflected beam is shown somewhat non-co-linearly with the illuminating beam being measured.

Figure 3:
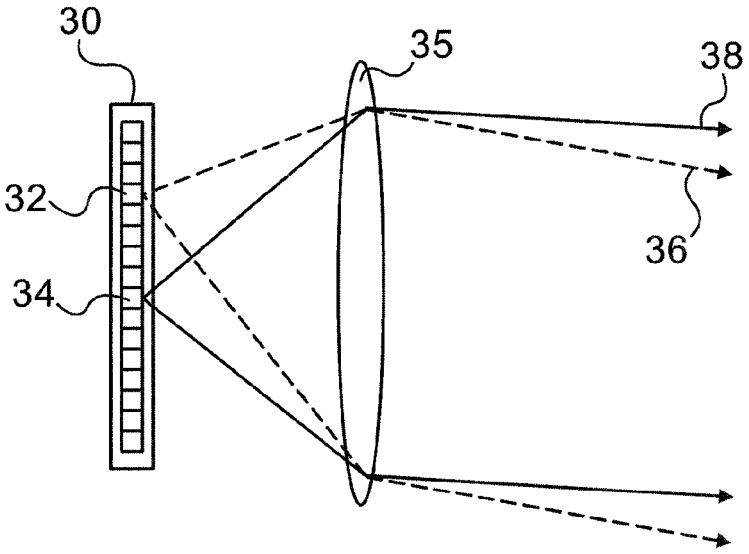
FIG. 3 is a schematic drawing of an exemplary configuration for implementing the generation of the fan of laser beams from a line of individual laser sources, using a collimating lens.

Reference is now made to FIG. 3, which is a schematic drawing of an exemplary configuration for implementing the generation of the fan of laser beams from a line of individual laser sources 30, which could be a linear array or individual sources attached together. A collimating lens 35 is disposed at its focal length away from the array, and each separate source is collimated by the lens into a beam directed in a direction depending on the position of the source element from the optical axis of the lens. Thus, the source 34 will have its emission directed as beam 38, which is almost axial because the source 34 is close to the optical axis of the transmitter assembly. Source 32 will have its beam 36 directed at an angle commensurate with the offset distance of pixel 32 from the optical axis. Thereby, each laser source pixel is transmitted in its own characteristic direction into the field, generating a fan of laser beams from the linear array of sources.

A similar collimating lens can be used for imaging the reflected light received from the field onto the sensor array 10, such that each pixel thereof can be attributed to light coming from a particular angular direction.

Other features of the system described in PCT/IL2009/000417 can be used with the present system, such as the measurement of the profile of the intruder, and the use of a signal processing program to discriminate the profile of a human intruder from that of wandering animals. In addition, a hybrid detection system can be used, in which the detection of the change of time of flight of the beams may be supplemented by the detection of changes in the illumination level detected, such that the intrusion data is verified with greater certainty. In such an implementation, the method by which a change in the terrain being surveilled is detected by means of a change in the time of flight of the laser beam reflected from that point the terrain, is supplemented by detection of changes in the illumination level detected. This is especially effective at long ranges, where the time of flight differences between closely spaced objects may be difficult to resolve with good accuracy. The sudden change in the intensity of the reflection may provide additional information to more clearly verify the indication of an intrusion suspected by the change in time of flight measurement of the reflected beam.

A high repetition rate pulsed laser source or sources, and a high-speed detector enables this system to perform its function of continuous measurement of the time of flight of reflections from the field from every one of the projected beams. Methods of processing the large amounts of data thus generated using commonly available electronic detection components are described in relation to the implementations of FIGS. 5A to 7 hereinbelow.

According to one exemplary implementation of the systems described in this disclosure, an array of laser beams each originating from a different laser source, are projected into the field of view, each beam in a different direction, and each beam having impressed upon it the point of time at which the laser beam is transmitted. The control circuitry receiving the reflected signals from the detector array can then determine the time delay between the transmission of the beam to its reception from the field by means of the particular temporal marker used for timing the beams. Use of laser beams coming from separate directed laser sources has an advantage in that there is no speckle effect on the detected light. In addition each measurement can be performed with less interference from reflections from the surface of the terrain.

According to another exemplary implementation of the system, instead of an array of individual laser beams, a curtain of laser light from a single laser source can be used, the source most conveniently, but not necessarily, being scanned vertically such that it includes the entire height of the curtain to be covered. The curtain beam must have directional information, such as an angularly dependent modulation signal, impressed on it, so that each different angle of the beam can be distinguished. In such an implementation, by measurement of the change in the time of flight detected when the intrusion occurs, the detector array is able to discern the distance of the intrusion, while the height above ground at which the intrusion occurs is determined by knowledge of which of the pixels of the detector array has detecting the change in arrival time of the reflected beam. This implementation too can thus discriminate between a human intruder and a stray animal. Use of a single curtain laser is significantly simpler and of lower cost than the use of an array of laser sources. In addition, readings of reflections from the continuous terrain surface are obtained, as opposed to measurements from single points on the terrain surface, which are obtained using an array of transmitted laser beams. However because a single coherent source with a limited coherence length is used, and it may be detected by a pixel after propagating through different path lengths, interference and speckle effects can cause problematic artifacts, which may render the method difficult to implement.

Figure 4A:
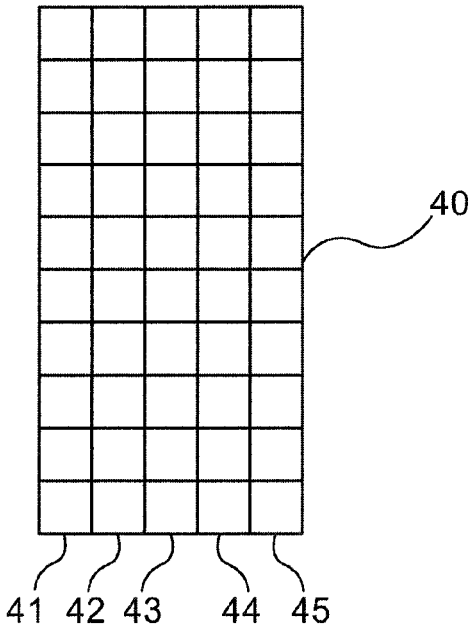
FIG. 4A illustrates schematically a two-dimensional detector array, such that the pixels on either side of the supposed detection center-line would detect reflections from any laterally errant transmitted beam.

Use of a single vertical array of detectors 10 in order to detect the reflected laser beams means that the transmitted beams must be directed very accurately in the azimuthal plane, since any lateral deviation of the laser beam would result in its illuminated regions in the field not being correctly imaged onto the detector array, and therefore being completely missed, or at least detected with lower sensitivity. In order to overcome this problem, it is possible to use a two-dimensional detector array, such that the pixels on either side of the supposed detection center-line would detect reflections from any laterally errant beam. Reference is now made to FIG. 4A, which illustrates schematically an example of such an array 40. The array has 10 pixels in the vertical direction each of which can detect a different vertical direction of received reflected beams, and five columns of pixels in the lateral direction 41-45. If the laser transmitter was directed correctly, the central row of pixels 43 would detect the reflected light coming from the field. If the array of laser beams is transmitted inaccurately azimuthally, it will be detected by one of the other columns of pixels in the lateral direction. The correct row of pixels to use for optimum detection of the reflected laser beams can be determined by projecting a fan of laser beams into the field and scanning each column, and observing which column of detectors gives the strongest reflected signal. That column will then be the column to use for the detection process. Such a test can be performed at regular intervals, in order to correct for any slow drift of the laser azimuthal direction with time.

Figure 4B:
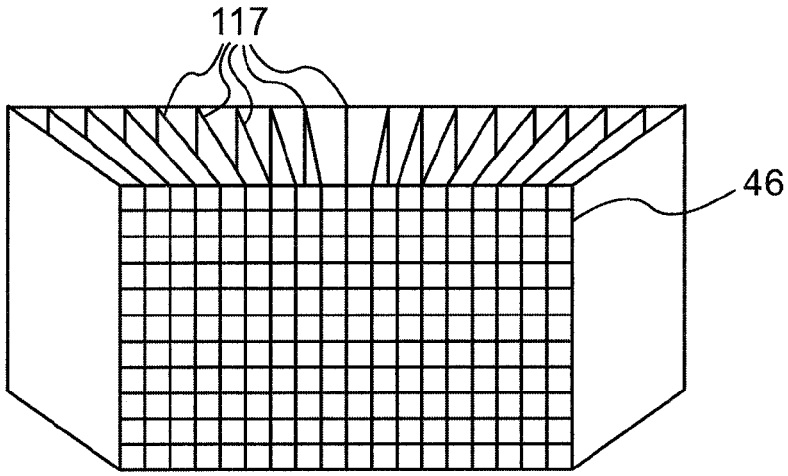
FIGS. 4B and 4C illustrate two alternative implementations for surveilling a three dimensional region.
Figure 4C:
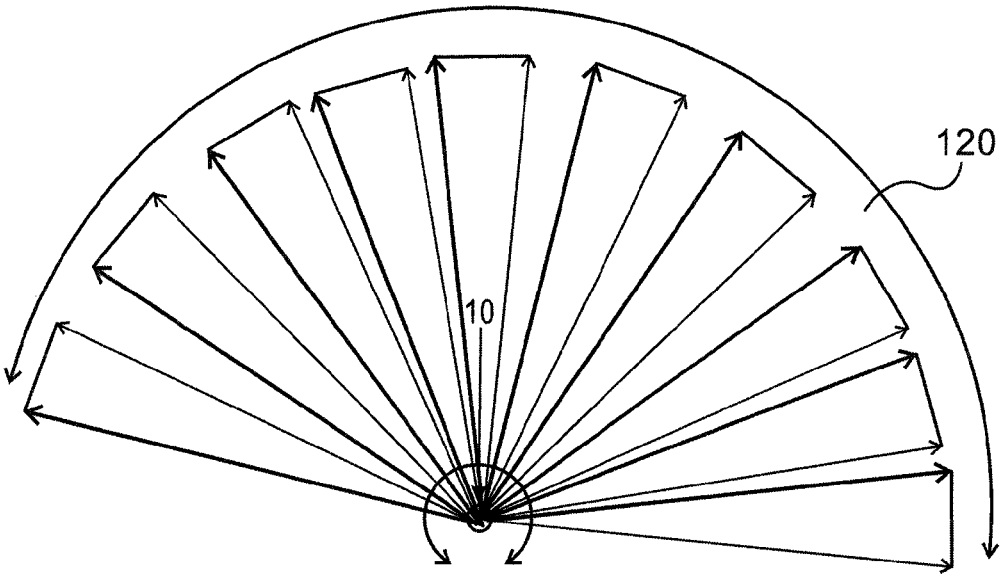

Reference is now made to FIGS. 4B and 4C, which illustrate yet another implementation of the present systems, in which a three dimensional region is surveilled. The probe laser beams are directed not only in a vertical direction but also cover an azimuthal angular sector. In the example of FIG. 4B, a two-dimensional image sensor 46, such as that shown in FIG. 4A, may be used instead of a linear detector array, and the laser beam array may then be scanned in the azimuthal direction perpendicular to its array axis. This scanning can be accomplished either by rotating the linear array about its axis, or by using a scanning device such as a rotating prism or mirror. Alternatively, the array can generate a fan of beams by using a lateral expansion element, such as a cylindrical lens, but in this case, since the light is spread simultaneously over the entire detection region, the intensity and hence the detection sensitivity is reduced. FIG. 4B shows the fan of fields of view 117 surveilled by the detector array.

As an alternative, FIG. 4C illustrates schematically an alternative method whereby a three-dimensional region can be surveilled. The entire linear curtain system, comprising both the linear laser array and the linear detector array, is rotated so that it scans sequentially different two-dimensional curtain planes. If the angular rotational velocity is made sufficiently slow that the temporal scan of a single two-dimensional plane is completed before the system rotates more than the angular width W of the two-dimensional plane, neighboring scanned planes will overlap so that a continuous three-dimensional scanned volume 120 is created. Since for every scan plane surveilled, the system can measure the intruder distance, size, shape and type, these capabilities are also kept in this three-dimensional system. The system thus behaves like an optical radar system, surveilling a three-dimensional region with the same high detection ability as the two-dimensional systems described above.

Since the detector array, whether a line array or a two-dimensional array, surveys the entire field of view in the direction of the terrain being surveilled, and the light reflected from the field has a low level, which could be significantly less than that of background effects such as direct sunlight or reflections thereof, or the headlights of vehicles, it is necessary to utilize some form of discrimination in order to identify the reflected laser beams from the general background level. As a first means, a band pass filter can be used, having a pass band around the wavelength of the laser light, and therefore filtering out much of the ambient sunlight. Such a filter can reduce the background effect by a factor of 50 or more, depending on the spectral width of the filter. However such a filter is not generally sufficient to overcome the effect of strong background light, and in co-pending PCT/IL2010/001057 for "Laser Daylight Designation and Pointing", hereby incorporated by reference in its entirety, there is described a system and method for discriminating weak reflected laser light from a bright background such as the ambient of a daylight scene, without the need to use a costly and complex high peak power pulsed solid-state lasers, as was used in prior art field surveillance and designating systems. This system then enables the use of low power laser diode sources for generating the transmitted probe beam or beams.

Figure 5A:
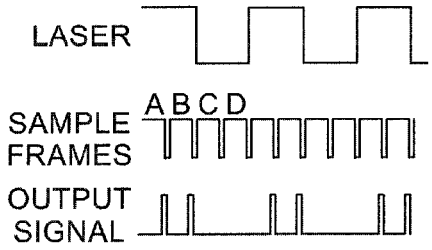
FIGS. 5A and 5B illustrate a method of subtracting alternate samples to discriminate pixels which have detected the reflected laser signal from the background illumination level.
Figure 5B:
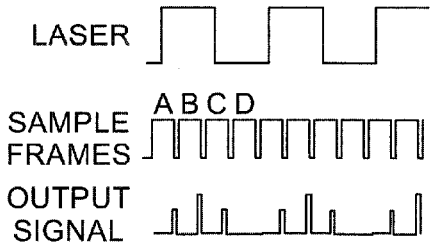

Reference is now made to FIGS. 5A and 5B, which illustrate the method by which this detection scheme operates. The transmitted laser beams, as shown in the top trace, are pulsed with a modulation frequency sufficiently high to code the transmitted beams and measure the transit time of the reflected light with the required accuracy. The beam is then sampled, as shown in the center trace, at a detector sensor rate which is a multiple of the laser modulation coded rate, such that by subtracting samples separated from each other by half of the laser modulation period, the background, which does not change appreciably from sample to sample, is subtracted out, while the laser reflection signal leaves a net measured intensity change between the samples. By this means it becomes possible to identify a reflected laser beam signal from the general slowly changing background illumination level, even if the background illumination level is stronger than the sought-after signal. In FIGS. 5A and 5B, an image sampling rate of 4 times the modulation frequency is shown, as is seen by comparing the top trace with the center trace.

FIG. 5A shows a situation where the laser modulation and the sampling rate are synchronized. The samples are labeled A, B, C and D. The algorithm used for background suppression is (A+B)−(C+D). Since the background does not change substantially between successive samples, the background detected in samples A and B is substantially the same as that detected in C and D, and therefore subtraction of the C+D signal from the A+B signal will leave the net laser reflected signal, bereft of any background contribution. The detected output signal thus appears in the lower trace as a strong signal at each pulse of the modulated laser. Likewise, if the signals were in the opposite phase, there would be signal contributions in samples C+D, but not in A+B.

FIG. 5B now shows the same detection scheme but where the laser modulation and the sampling rate have an intermediate phase relation, in this case, out of phase by 90°. For this situation, the algorithm used for background suppression is (B+C)−(A+D), and the detected output appears in the lower trace as a series of integrated signals of lower intensity than that of FIG. 5A, but at the correct point in time of occurrence of each pulse of the modulated laser. Therefore, by using a sampling rate of significantly more than twice the laser modulation frequency, the problem of phase synchronization can be essentially eliminated.

In order to make these measurements at a frequency which provides sufficient accuracy for the time-of-flight measurement, it is therefore necessary to be able to read out data from the detector arrays at frame rates of at least several kilohertz. Sensor arrays and their associated CCD or CMOS readout circuitry operating at such high sampling rates are available, but are currently very expensive or even non-standard, and require complex drive circuitry. It would be preferable to use standard image sensors, which are less expensive, have lower power consumption and are commonly available. However, standard, low cost sensor arrays have a frame rate of the order of 20 to 30 Hz, as compared with the required several kHz rate, so a method must be devised to enable use of such standard sensor arrays in these systems.

In co-pending PCT/IL2010/001057, a method is suggested for solving this problem, in which use is made of a CCD or a CMOS with pixels having two charge registers that can be alternately filled at a rate in the kHz region. The signal is collected by one charge register, while the background is collected equally by both. Subtracting the two charge registers would filter the background from the signal. This system can be implemented using either of two different CCD configurations—the interlaced CCD or the interline progressive scan CCD.

Figure 5C:
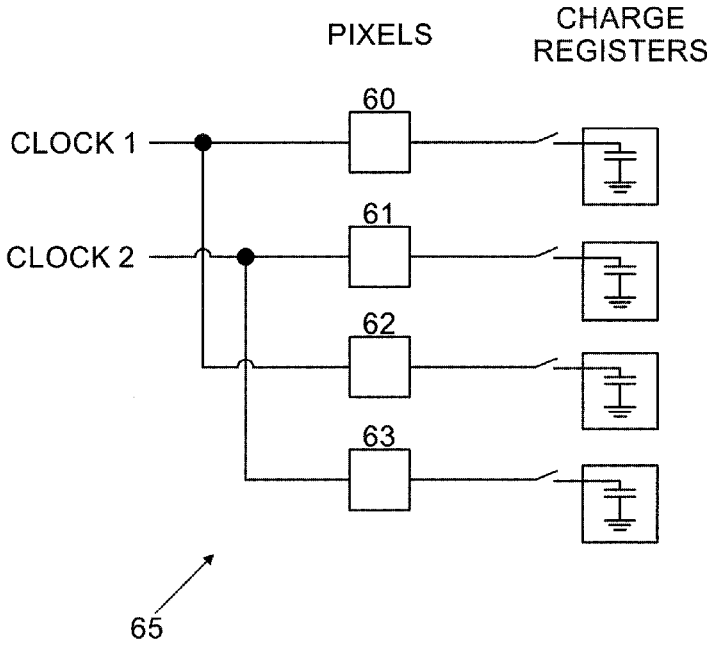
FIG. 5C illustrates schematically an interlaced CCD, configured to filter the background signal from the desired reflected modulated laser signal.

Reference is now made to FIG. 5C, which illustrates schematically an interlaced CCD, configured to implement the method of filtering the background signal from the desired reflected modulated laser signal, as shown in co-pending PCT/IL2010/001057. An interlaced CCD has a different readout clock for the odd rows and for the even rows. The readout clock rate can be synchronized with the modulation rate, which is several kHz in the example system cited herein, so that one of the rows collects the detected laser light including the background, and the other row collects the background only. Subtracting rows then filters the background, leaving the desired reflected modulated laser signal. In FIG. 5C, two exemplary pixels 60 and 62 of a complete CCD array 65 are driven by clock 1 and another two pixels 61 and 63 by clock 2. If the laser modulation is in phase with, for instance, clock 1, the detected laser signals will appear in the charge register capacitors of pixels 60 and 62. The background will be detected by all of the pixels, 60, 61, 62 and 63. By subtracting the charges in the register capacitors associated with pixels 60 and 62 from those associated with pixels 61 and 63 (or vice versa), the background charges are cancelled, while the signal charges remain. The novelty of this system is that although the individual register capacitors accumulate charges at the rate determined by the modulation pulses of the CW laser, once the charges have accumulated in their respective registers for the frame period of the CCD, they can be read out at the comparatively low frame rate of the standard CCD device. In this way, it is possible to use a standard CCD device, operating typically at a 20 or 30 Hz frame rate, in order to detect the image signals modulated in the several kHz range.

An alternative implementation makes use of a CCD device having two isolated charge registers for every pixel. Switching between the separate charge registers at the laser modulation rate, enables the above described advantages to be obtained, the reflected laser light together with the background level being stored in one charge register, and the background only in the other.

In the present system, it is necessary to measure the range of the feature in the field from which each reflected light beam is obtained. Consider a modulated CW laser beam projected at an object in the field and the reflected illumination detected. The difference in phase between the transmitted pulse and the pulse received arises from the transit time of the laser pulse to and from the target, and can be used to determine the range of the target. Considering the case where the beam is modulated at a frequency of 1 MHz. Such a frequency, of at least in the few MHz range, is required in order to be able to measure a range at the typical distances of an intrusion detection system without undue ambiguity. A transit time difference between successive 1 MHz pulses is equivalent to a to-and-fro optical transmitted distance of 300 meters, i.e. 150 m to the point at which the reflection from the intrusion is measured. A lower frequency would mean an increased effective range which would limit the accuracy of the range measurement within that distance range, while a higher frequency would increase the accuracy of the measurement, but at the same time would shorten the useful measurement range, because of the shortening of the repetition distance ambiguity resulting from the inability to distinguish how many of such ranges have given rise to the phase change of the reflected illumination being measured.

However it is very difficult to accurately measure phase differences in the MHz frequency range and to process the information used to designate each projected beam, for a large number of pixels in a detector array. The amount of information to be processed in order to measure the phase difference at each pixel of the detector array is large and low cost detector arrays are therefore unsuitable for this purpose using prior art readout technology. Therefore, a method is proposed whereby the receiver circuitry is able to convert the high CW laser modulation frequency to a value more manageable in order to be able to readily measure the phase difference between every successive one of the transmitted and received pulses.

Figure 6:
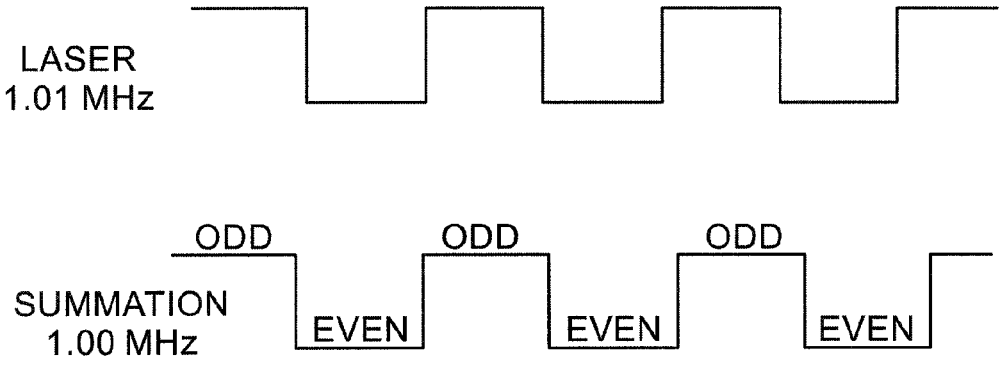
FIG. 6 shows time graphs of a received laser beam modulated at one frequency, with the summation of the individual ON and OFF half periods of the received illumination performed at a slightly different frequency in order to enable range measurements based on the phase change at the substantially lower difference frequency.

As is observed in FIGS. 5A and 5B, regardless of the sampling rate, the output signal including the reflected laser pulse is present during the time when the laser pulse is received on the detector. Referring now to FIG. 6, there is shown schematically in the upper section of the drawing, a train of laser pulses resulting from a 1.01 MHz modulation of the CW laser diode, received by reflection from an object in the field whose range is to be determined. In order to perform the range measurement according to this novel detection system, the receiver summing rate for each half period of the modulated light is maintained at a slightly different frequency, which for the example shown in FIG. 6 could typically be 1.00 MHz. Such a sampling pattern is shown in the bottom trace of FIG. 6, where the alternate sampling periods are nominally labeled ODD or EVEN. The difference between the two time traces has been exaggerated in FIG. 6, to illustrate the process. As previously, when readout is performed, from the differences between the output signal (ODD) and the "non-output" signal (EVEN), the laser signal can be obtained with the effect of the background illumination subtracted therefrom. In order to simplify the explanation, the effect of the background illumination will now be ignored, and the signals referred to simply as the laser signals.

During the first ODD sample shown on the left hand side of FIG. 6, the summing period and the laser signal exactly overlap, and the full level of output signal is obtained. At the second ODD sample, there has been a small time shift between the 1.01 MHz laser pulse and the 1.00 MHz sampling period, such that part of the laser signal is not summed, and the output signal is thus smaller. This process continues until the laser pulse and the summing period are in opposite phases, namely that the laser pulse falls on the EVEN non-output summing period, and the output signal has thus fallen to zero. After another equal number of summing periods, the laser pulse and the ODD summing periods are again in phase, and the output signal returns to its maximum value. This occurs after a time equivalent to the period of a 10 kHz waveform, this being the frequency difference between the laser modulation train frequency of 1.01 MHz, and the summing rate of 1.0 MHz, i.e. after 0.1 msec. In other words, since the 1.01 MHz received signals are summed at a 1.00 MHz rate, the resulting output is a signal modulated at 10 kHz, and having a sinusoidal shape.

Figure 7:
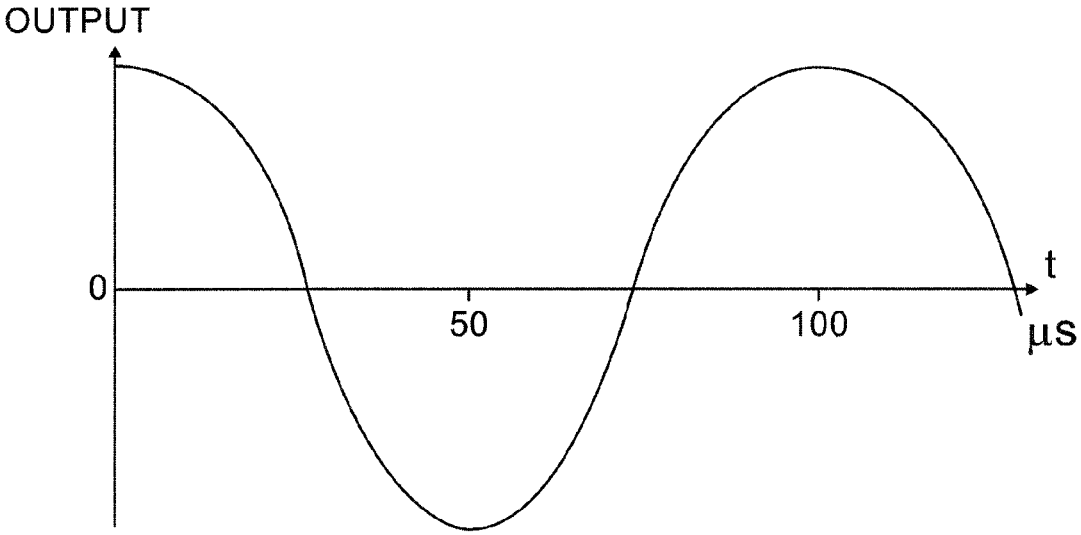
FIG. 7 is a schematic graph of the output signal obtained from the range measurement scheme described in FIG. 6.

FIG. 7 illustrates schematically how the output varies sinusoidal with time, having a period of 100 μsec. Thus the laser image signal read-out will fluctuate at the difference frequency of 10 kHz. The importance of this summation procedure in the receiver is that, like heterodyne detection in a radio receiver, the signal information in the received 1 MHz modulated laser beam is impressed onto the 10 kHz detected signal envelope, and can be extracted therefrom. Thus, the phase shift information arising from the time difference between transmission and reception of the 1.01 MHz laser pulses, can be measured from the 10 kHz envelope. Determination of an accurate phase difference at 10 kHz can be readily performed electronically, unlike a direct measurement at 1 MHz, which is difficult to perform for a large number of signal samples.

The range measurement of the point from which the laser beam has been reflected in the field, is obtained from the change in phase which the 10 kHz received reflected signal has undergone, relative to a 10 kHz signal generated from the transmitted laser signal at the point in time at which the laser pulse associated with the reflected signal was transmitted.

The intrusion detection systems so far depicted have been described as determining only the presence and range of an intrusion, with the option of determining the profile of the intruder also, mainly in order to discriminate between a human intrusion and an animal. According to further implementations of the systems of the present disclosure, it is also possible to view an image of the intruder once an intrusion warning has been given. The complete imaged field of view can then be inspected with the intruder displayed on the background. Such an image can be obtained with the systems described in the present disclosure by adding the samples separated from each other by half of the laser modulation period, instead of subtracting them as was described in FIGS. 5A and 5B and 6. An image of the complete field of view is then obtained from the summed samples. Where a complete field of view image is available, any anomalies in the intrusion detection may then be fully resolved by viewing the image.

The above referenced examples have been described using a 50% duty cycle for the pulsed laser beams, i.e. equally spaced transmission and dark periods, as shown in FIGS. 5A and 5B. According to further implementations of the present systems, it is possible to use a gated imaging system, whereby the laser beams are modulated and the reflected beams detected at a lower duty cycle, thus enabling the detection range to be limited to part of the total possible range. Thus for instance, if the duty cycle is reduced to only 10% instead of 50%, and during the rest of the cycle, the laser beams are not transmitted, then it will be possible to limit the range in which an intrusion will be detected to only 20% of the total potential range. By moving the position of the ON period within the modulation cycle, it becomes possible to move the limited range region within the total range which the system can detect. Thus, if an intrusion is expected or suspected within a certain region of the terrain surveilled, it is possible to concentrate the detection capabilities to that region in order to concentrate search effort therein.

A number of further novel aspects of the intrusion detection system of the present disclosure are now presented. The use of a 2-dimensional array instead of a line array has already been shown in FIG. 4A as an attempt to overcome any lack of pointing stability in the laser array. Another method of improving the stability of the measurement system can be proposed by using servo-mechanisms to mechanically align the lasers and detector array, such that the output of the array elements are maximized. When this occurs, both the lasers and the detector arrays are optimally aligned.

Another improvement to prior art systems can be achieved by the use of auto-focusing assemblies for the laser diodes. The focal length of the laser diodes can change with time, resulting in change of the Rayleigh length of the lasing beam, and degradation of the detected signals. Therefore, it is important to provide an auto-focusing mechanism that will ensure optimum focus at all times. This can be achieved by viewing the detector output of a pixel, and adjusting the focal position of the lens such that the maximum detected power is achieved.

A further problem which needs to be addressed is that of detection of an intrusion near a wall. If there is an obstruction such as a building or a wall in the line which the Intrusion detection system is protecting, then there will be a permanent reflection from that building or wall. If an intruder then breaks the laser shield at a point close to the wall, the system may not be able to resolve the intrusion reflection from that of the wall, because of the close temporal relationship between them, and the intrusion may then go undetected. In the previously described implementations of such systems in PCT/IL2009/000417, a threshold level of the received light is determined, and that threshold level is taken to determine whether there has or has not been a change of significance in the reflection detected by the pixels. By this means, the detection system adopts aspects of a digital system with its concomitant advantages. In order to avoid the situation of lack of temporal resolution near a permanent obstruction, it is proposed that in addition to the time of flight measurement of the reflected laser pulses in the various pixels of the detector array, the measured change in level of the reflected light be measured. Then, if one pixel shows a quantitive change in reflection in temporal coordination with a quantitive change in the opposite direction of the output of another pixel, that can be taken as evidence of an intrusion at the time-of-flight measured range, even if no definitive threshold change has been detected. The sensitivity of detection is thereby increased.

Furthermore, if the intrusion protection system is installed in a region where there is significant atmospheric interference with the laser transmission characteristics, then according to a further improvement of the intrusion detection system, it is proposed that the output from a number of adjacent pixels be added or averaged, and this combined or averaged output be used to determine any changes in one time frame in the time of arrival of the received laser beams. By this means, local fluctuations due to atmospheric disturbances will be averaged out.

It is appreciated by persons skilled in the art that the present invention is not limited by what has been particularly shown and described hereinabove. Rather the scope of the present invention includes both combinations and subcombinations of various features described hereinabove as well as variations and modifications thereto which would occur to a person of skill in the art upon reading the above description and which are not in the prior art.

The invention claimed is:

1. A system for range detection, comprising:

an illuminating source, adapted to direct illuminating beams modulated at a predetermined frequency, along a plurality of angularly divergent optical paths;

an array of detector elements, adapted to image reflected light from said plurality of angularly divergent optical paths; and a signal processing unit adapted to:

(i) accumulate signals from said array of detector elements arising from said reflected light, at a rate which is a multiple of said predetermined frequency;

(ii) subtract accumulated signals temporally separated from each other by half of the modulation period associated with said predetermined frequency, such that said resultant signals are representative of said reflected light from a detected object in said optical paths without the effect of any background illumination; and (iii) ascertaining the time of flight of any one of said illuminating beams, between the time of transmission from its illuminating source to the time of detection in its detection element, wherein the range of an object along any of said angularly divergent optical paths can be determined from said time of flight ascertained for said illuminating beams reflected from said plurality of angularly divergent optical paths.

2. A system according to claim 1 wherein said accumulated signals temporally separated from each other by half of said modulation period are accumulated in separate CCD charge registers, such that said accumulated signals can be read out at a rate substantially lower than said predetermined modulation frequency.

3. A system according to claim 1 wherein said accumulated signals temporally separated from each other by half of the modulation period, enable the subtraction of signals arising from background illumination from signals arising from said reflected laser beams.

4. A system according to claim 1, wherein a change in said time of flight of any one of said illuminating beams indicates that an intrusion has occurred along said angularly divergent optical path associated with said change in time of flight of said illuminating beam.

5. A system for range detection, comprising:

an illuminating source, adapted to direct illuminating beams modulated at a first frequency along a plurality of angularly divergent optical paths;

an array of detector elements, adapted to image reflected light from said plurality of angularly divergent optical paths; and a signal processing unit adapted to:

(i) accumulate signals from said array of detector elements arising from said reflected light at a second frequency which is separated from said first frequency by a difference frequency which is substantially less than said first frequency; such that output signals are generated from said accumulating having said difference frequency;

(ii) generate an illuminating source signal by sampling said first frequency at the rate of said second frequency;

(iii) measure the phase delays between output signals and their associated illuminating source signals; and (iv) determine at said difference frequency from said phase delays, the time of flight of illuminating beams between their time of transmission from their illuminating source to the time of detection in their associated detection elements, wherein the range of an object along any of said angularly divergent optical paths can be determined from said time of flight determined for said illuminating beams reflected from said plurality of angularly divergent optical paths.

6. A system according to claim 5, wherein signals temporally separated from each other by half of said modulation period are accumulated in separate CCD charge registers, such that said accumulated signals can be read out at a rate substantially lower than said first modulation frequency.

7. A system according to claim 5 wherein said accumulated signals are modulated at said difference frequency, such that any phase information impressed thereon can be electronically measured at said difference frequency.

8. A system according to claim 5 wherein a change in said time of flight of any one of said illuminating beams indicates that an intrusion has occurred along said angularly divergent optical path associated with said change in time of flight of said illuminating beam.

9. A method for range detection comprising:

transmitting an array of illuminating beams modulated at a predetermined frequency, along a plurality of optical paths, said optical paths being angularly divergent from a point from which said transmitting is performed;

detecting illumination reflected from said region along said plurality of optical paths;

accumulating signals from said array of detector elements arising from said reflected light, at a rate which is a multiple of said predetermined frequency;

subtracting accumulated signals temporally separated from each other by half of the modulation period associated with said predetermined frequency, such that said resultant signals are representative of said reflected light from a detected object in said optical paths without the effect of any background illumination;

measuring the time of flight of any one of said illuminating beams, between the time of transmission from its illuminating source to the time of detection in its detection element; and determining the range of an object along any of said angularly divergent optical paths from said time of flight measured for said illuminating beams reflected from said plurality of angularly divergent optical paths.

10. A method according to claim 9 further comprising the step of accumulating said signals temporally separated from each other by half of said modulation period in separate CCD charge registers, such that said accumulated signals can be read out at a rate substantially lower than said predetermined modulation frequency.

11. A method according to claim 9 wherein said accumulated signals temporally separated from each other by half of said modulation period, enable the subtraction of signals arising from background illumination from signals arising from said reflected laser beams.

12. A method according to claim 9, further comprising the step of determining that an intrusion has occurred along said angularly divergent optical path associated with said change in time of flight of said illuminating beam.

13. A method for range detection comprising:

transmitting an array of illuminating beams modulated at a predetermined frequency, along a plurality of optical paths, said optical paths being angularly divergent from a point from which said transmitting is performed;

detecting illumination reflected from said region along said plurality of optical paths;

accumulating signals from said array of detector elements arising from said reflected light at a second frequency which is separated from said first frequency by a difference frequency which is substantially less than said first frequency; such that output signals are generated from said accumulating, having said difference frequency;

generating an illuminating source signal by sampling said first frequency at the rate of said second frequency;

measuring the phase delays between output signals and their associated illuminating source signals; and determining at said difference frequency, from said phase delays, the time of flight of illuminating beams along said plurality of angularly divergent optical paths, between their time of transmission from their illuminating source to the time of detection in their associated detection elements, detecting the range of an object along any of said angularly divergent optical paths from said time of flight determined for said illuminating beams reflected from said plurality of angularly divergent optical paths.

14. A method according to claim 13 further comprising the step of accumulating signals temporally separated from each other by half of said modulation period, in separate CCD charge registers, such that said accumulated signals can be read out at a rate substantially lower than said first modulation frequency.

15. A method according to claim 13 wherein said accumulated signals are modulated at said difference frequency, such that any phase information impressed thereon can be electronically measured at said difference frequency.

16. A method according to claim 13, further comprising the step of determining that an intrusion has occurred along said angularly divergent optical path associated with said change in time of flight of said illuminating beam.

* * * * *